US008025181B1

(12) United States Patent
Horn et al.

(10) Patent No.: US 8,025,181 B1
(45) Date of Patent: Sep. 27, 2011

(54) SANITARY THREADED ROD LID DISPENSER

(76) Inventors: Terry Horn, Mustang, OK (US); Jerry Horn, Mustang, OK (US)

( * ) Notice: Subject to any disclaimer, the term of this patent is extended or adjusted under 35 U.S.C. 154(b) by 0 days.

(21) Appl. No.: 12/319,185

(22) Filed: Jan. 3, 2009

(51) Int. Cl.
*H65H 1/08* (2006.01)
*B65H 5/00* (2006.01)

(52) U.S. Cl. ..... 221/226; 221/4; 221/5; 221/6; 221/221; 221/312 A; 221/312 R; 221/282; 221/283; 221/256; 221/279; 221/223; 221/124; 221/123; 221/208; 312/71; 312/45; 312/42; 401/87; 222/44

(58) Field of Classification Search ..... 312/71, 312/45, 42; 401/87; 222/44; 221/221, 312 A, 221/312 R, 282, 283, 256, 279, 226, 223, 221/124, 123, 208, 6, 5, 4
See application file for complete search history.

(56) References Cited

U.S. PATENT DOCUMENTS

| | | | | | |
|---|---|---|---|---|---|
| 2,215,850 | A | * | 9/1940 | Holdeman | 312/45 |
| 2,985,339 | A | * | 5/1961 | Fischer et al. | 222/44 |
| 3,241,706 | A | * | 3/1966 | Monaco et al. | 206/558 |
| 4,312,172 | A | * | 1/1982 | Fisher et al. | 53/489 |
| 4,643,334 | A | | 2/1987 | Steele | |
| 4,699,161 | A | * | 10/1987 | Smith et al. | 132/73.5 |
| 4,858,783 | A | | 8/1989 | Mayfield, III | |
| 5,012,952 | A | | 5/1991 | Franz | |
| 5,056,684 | A | * | 10/1991 | Beach et al. | 221/197 |
| 5,152,590 | A | * | 10/1992 | Dukes | 312/71 |
| 5,477,983 | A | * | 12/1995 | Davis | 221/279 |
| 5,944,220 | A | * | 8/1999 | Garske et al. | 221/312 A |
| 5,975,839 | A | | 11/1999 | Ashby | |
| 6,474,503 | B2 | | 11/2002 | Davis | |
| 6,659,305 | B2 | | 12/2003 | Thompson | |
| D489,950 | S | * | 5/2004 | Malik et al. | D7/669 |
| 7,073,966 | B2 | * | 7/2006 | Murakoshi | 401/87 |
| 7,207,462 | B2 | | 4/2007 | Gunderson | |
| 7,337,919 | B2 | | 3/2008 | Walsh | |
| 7,882,980 | B1 | * | 2/2011 | Horn et al. | 221/226 |
| 2006/0049207 | A1 | * | 3/2006 | Bogoshian et al. | 222/196 |
| 2006/0226169 | A1 | * | 10/2006 | Davis et al. | 221/211 |
| 2009/0032367 | A1 | * | 2/2009 | Anthome | 194/210 |

* cited by examiner

*Primary Examiner* — Gene O. Crawford
*Assistant Examiner* — Rakesh Kumar
(74) *Attorney, Agent, or Firm* — Martin G. Ozinga; Phillips Murrah PC

(57) ABSTRACT

A dispensing device for beverage cup lid which prevents excessive human contact with the lid prior to insertion upon the beverage cup, the device providing an externally threaded central rotary rod attached to a direct drive bidirectional electrical motor and suspended within a lid cabinet with a stacked plurality of lids retained upon the rotary rod through a central bore in each lid, the lids urged downward by a traveling press plate having a central threaded hole engaging the external threads of the rotary rod, the rotation of the rotary rod causing the press plate to move up and down the rotary rod, pressing against the uppermost lid on the rotary rod against the stacked plurality of lids in increments programmed to release only the lowermost lid from the end of the rotary rod in a receiving area below the retaining rod. The device is operated by the activation of a presence sensor, either a beverage cup or a clean hand, which causes the incremental dispensing of a single lid.

5 Claims, 7 Drawing Sheets

SANITARY THREADED ROD LID DISPENSER

CROSS REFERENCE TO RELATED APPLICATIONS

Patent application Ser. No. 12/218,389 filed on Jul. 15, 2008, by the same inventors, Terry Horn and Jerry Horn, and assigned to the same assignee, Sanitary Lid Dispensers, Inc., Mustang, Okla.

BACKGROUND OF THE INVENTION

1. Field of Invention

A dispensing device for beverage cup lid which prevents excessive human contact with the lid prior to insertion upon the beverage cup, the device providing an externally threaded central rotary rod attached to a direct drive bidirectional electrical motor and suspended within a lid cabinet with a stacked plurality of lids retained upon the rotary rod through a central bore in each lid, the lids urged downward by a traveling press plate having a central threaded hole engaging the external threads of the rotary rod, the rotation of the rotary rod causing the press plate to move up and down the rotary rod, pressing against the uppermost lid on the rotary rod against the stacked plurality of lids in increments programmed to release only the lowermost lid from the end of the rotary rod in a receiving area below the retaining rod. The device is operated by the activation of a presence sensor, either a beverage cup or a clean hand, which causes the incremental dispensing of a single lid.

2. Description of Prior Art

The following United States patents were discovered and are disclosed within this application for utility patent. All relate to devices which provide for the dispensation of a drink cup lid, either manually or by operation of a mechanical means. A recent U.S. Pat. No. 7,337,919 to Walsh, a manually operated beverage lid dispenser indicates a contained stack of lids within a cylinder which are horizontally separated from a stack by gravity, one at a time, and horizontally moved by a slide plate which contains the single separated lid and draws it out from beneath the stack for presentation in an inverted position. One must use their hand to remove the lid and right it for application to a beverage cup. Similar devices are disclosed in U.S. Pat. No. 6,474,503 to Davis for drink lids and U.S. Pat. No. 5,975,839 to Ashby for disks, primarily stacked recording media.

A spring is used to push cups and lids upward in a cylindrical stack in U.S. Pat. No. 4,858,783 to Mayfield, Ill. A similar spring type device is used for the horizontal thrust and presentation of beverage lids in both U.S. Pat. No. 5,012,952 to Franz and U.S. Pat. No. 7,207,462 to Gunderson. A mechanical device segregates a single lid from a stack and slides the lid through a slot in the device framework by the rotation of a plurality of gears which separate, grasp and move the lid from its stacked position to the slot by some manually activated means in U.S. Pat. No. 6,659,305 to Thompson. Two simple stacked cylindrical lid dispensing devices are disclosed in U.S. Pat. No. 4,643,334 to Steele and U.S. Pat. No. 2,215,850 to Holdeman. None of the above devices places a stacked group of lids on an externally threaded rotary rod, they do not involve a press plate engaging the rotary rod which apply force to the top of the stacked lids to force the stack downward in a programmed incremental distance to release a single lid, and they do not provide an option for the dispensing of a lid without human contact with the lid prior to being applied to the cup. They also do not disclosed the components similar to the present device to load and unload the lids nor the sensors applied to activate the motion of the device.

SUMMARY OF THE INVENTION

In the food and beverage industry, the potential for contamination of foods and beverages by food handlers has received much attention. Bacteria, viruses and sometimes just plain filth may be passed onto a customer by a food handler or by items which come into contact with food and beverages. Illness and sickness can result, and in rare instances, even death through food poisoning, *E. Coli* contamination or hepatitis. Reducing the amount of human contact with food or beverages and their service containers has been demonstrated to proportionally reduce the risks.

Most commercially available beverage and food containers are presented as a cup or bowl which has a plastic lid which engages the perimeter of the cup or bowl. In conventional lid dispensers, where provided, a server or customer is required to grab a lid out of an open dispenser, coming into contact with at least one lid, but often several when sorting through the find the right size or shape. It could be possible that a single lid in this type dispensary could have been touch by more than one person whose hygiene might range from very recently clean to horrible filthy. It could only be imagined just how dirty a "clean" lid could become under these circumstances. Thus, a touch free lid dispenser which dispenses a lid onto a container or into the consumer's hand for placement upon a container would be desired to further a food and beverage provider's goal of providing sanitary lids to their customers The primary objective of the invention is to provide a device which provides and dispenses a single sanitary beverage or bowl lid to a customer with a minimal amount of exposure to contact with non-sanitary people. A second objective is to provide the device with a presence sensor to cause the dispensing of a single stacked lid without requiring contact with the single lid until after being dispensed. A third objective is to provide the device to be refilled with a stacked plurality of sanitary lids after the last lid in the stack is dispensed. A fourth objective is to provide the rotary rod with a press plate urging the top most lid down the stationary rod to apply a uniform pressure on the lid to reduce any potential deformation of the sanitary lid as it being dispensed from the device. A fifth objective is to provide the device to have all controllers and sensors within an integrated circuitry area segregated from a drive and dispensing area containing the drive mechanisms, moving parts, sanitary lids and other mechanical hardware for sanitary purposes.

DESCRIPTION OF THE DRAWINGS

The following drawings are submitted with this utility patent application.

FIG. 8 is a wiring diagram of the electrical components utilized in the lid dispenser.

DESCRIPTION OF THE PREFERRED EMBODIMENT

Figure 3:
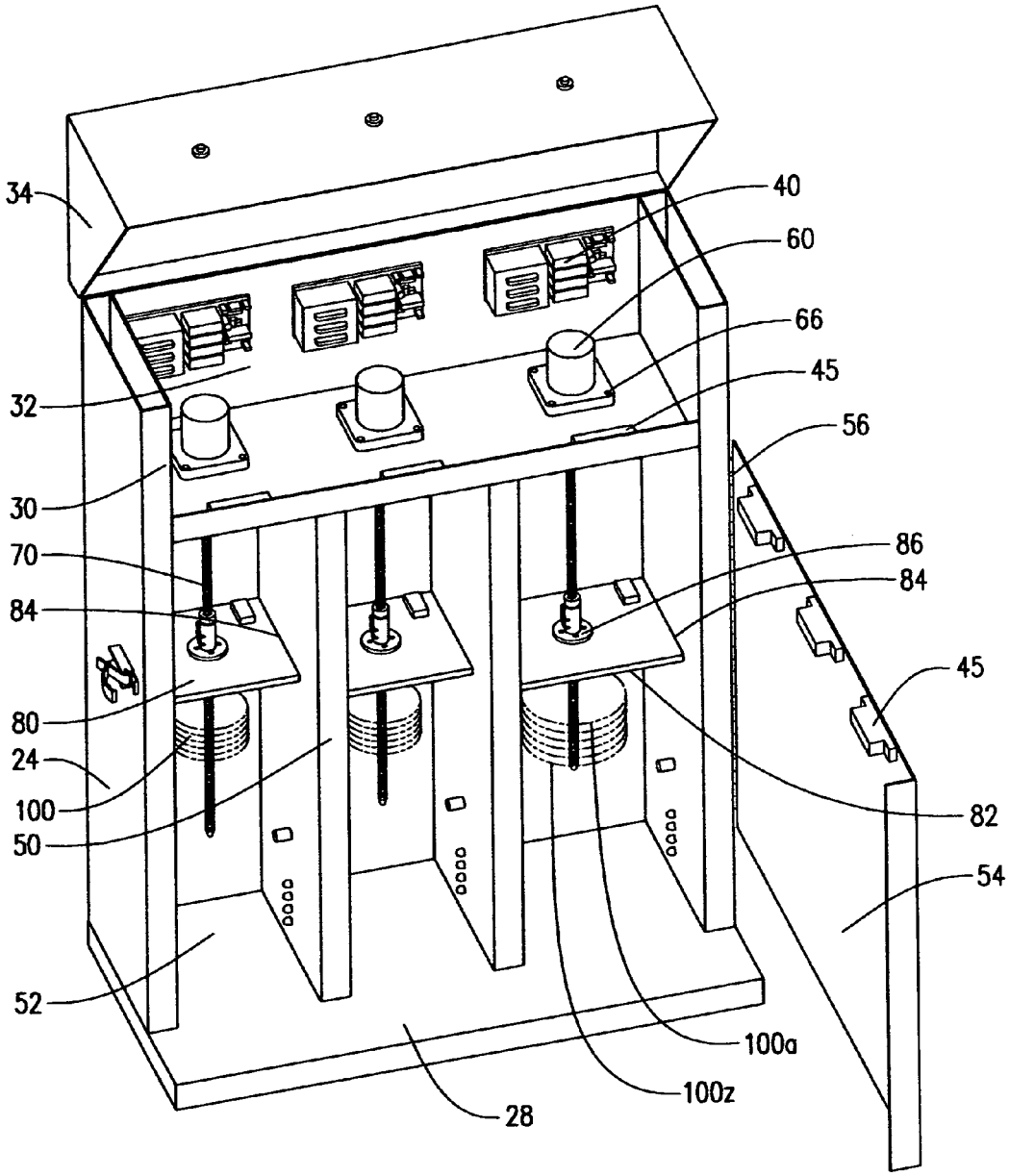
FIG. 3 is a front view of an embodiment of the lid dispenser with the upper access door open and the front panel open, revealing three service compartments within the front service enclosure.
Figure 4:
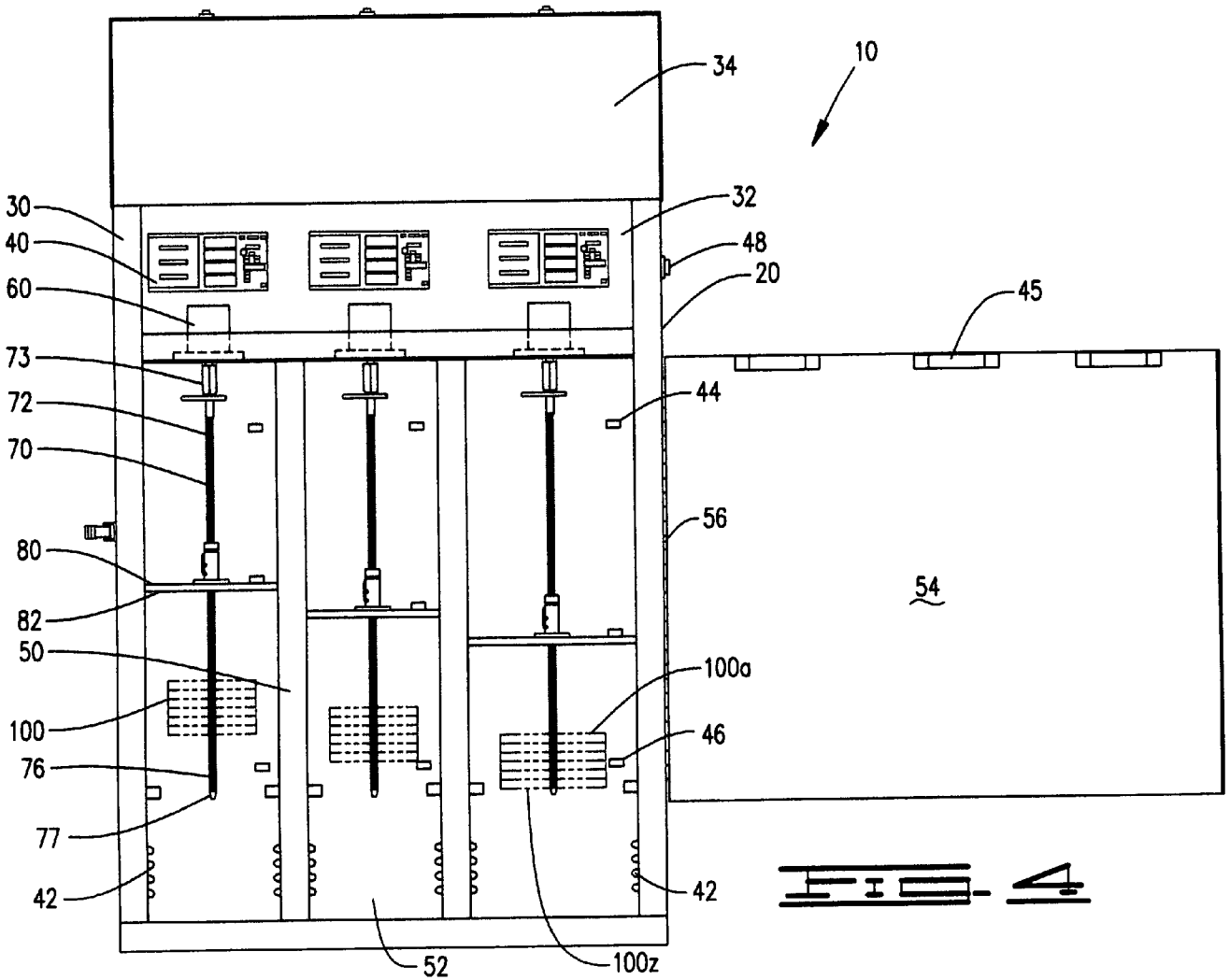
FIG. 4 is an elevation view of the lid dispenser with the upper access door open and the front panel open.
Figure 5:
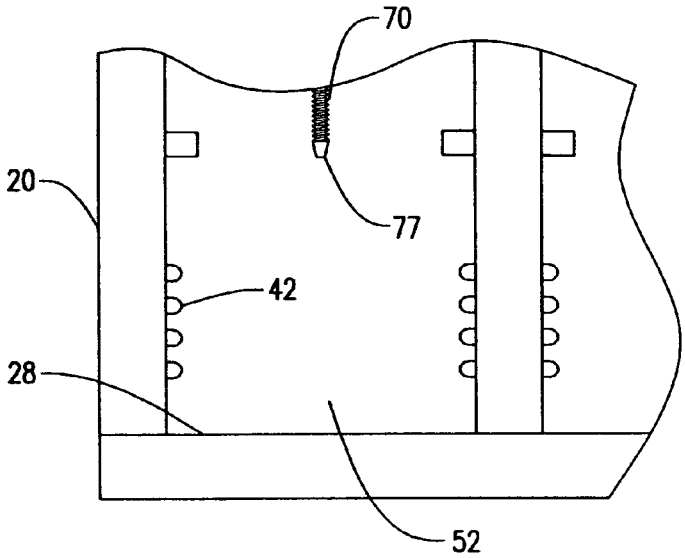
FIG. 5 is a close up front view of the rotary rod and the presence sensor within the service compartment.
Figure 6:
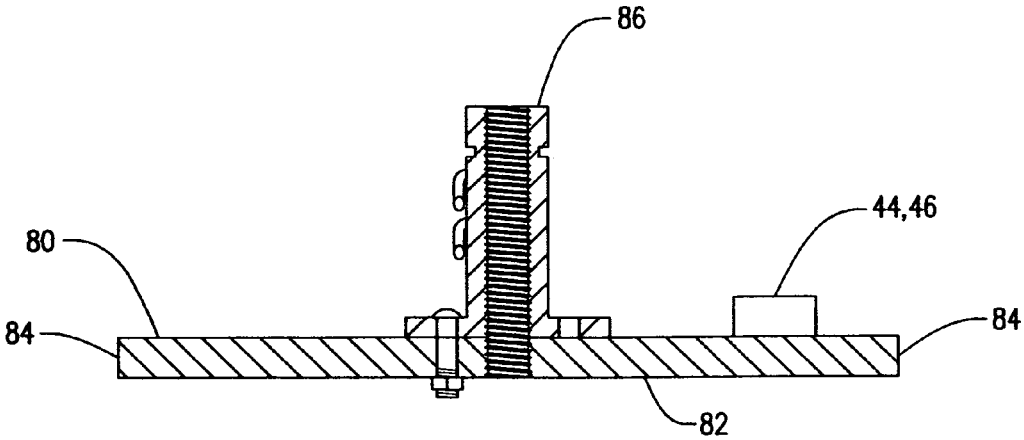
FIG. 6 is a cross sectional view of the press plate and the rotary rod.
Figure 7:
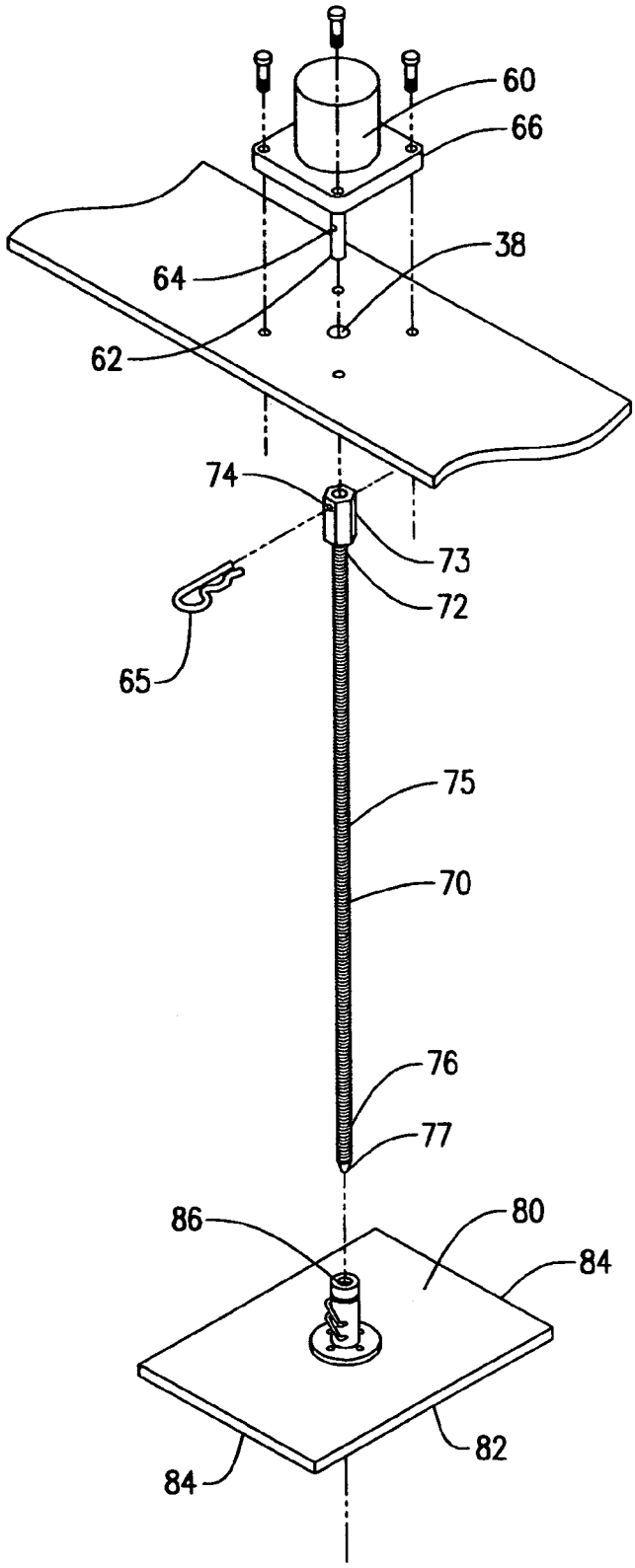
FIG. 7 is an exploded diagram of the press plate, the rotary rod and the motor and motor shaft and connector pin.
Figure 7:
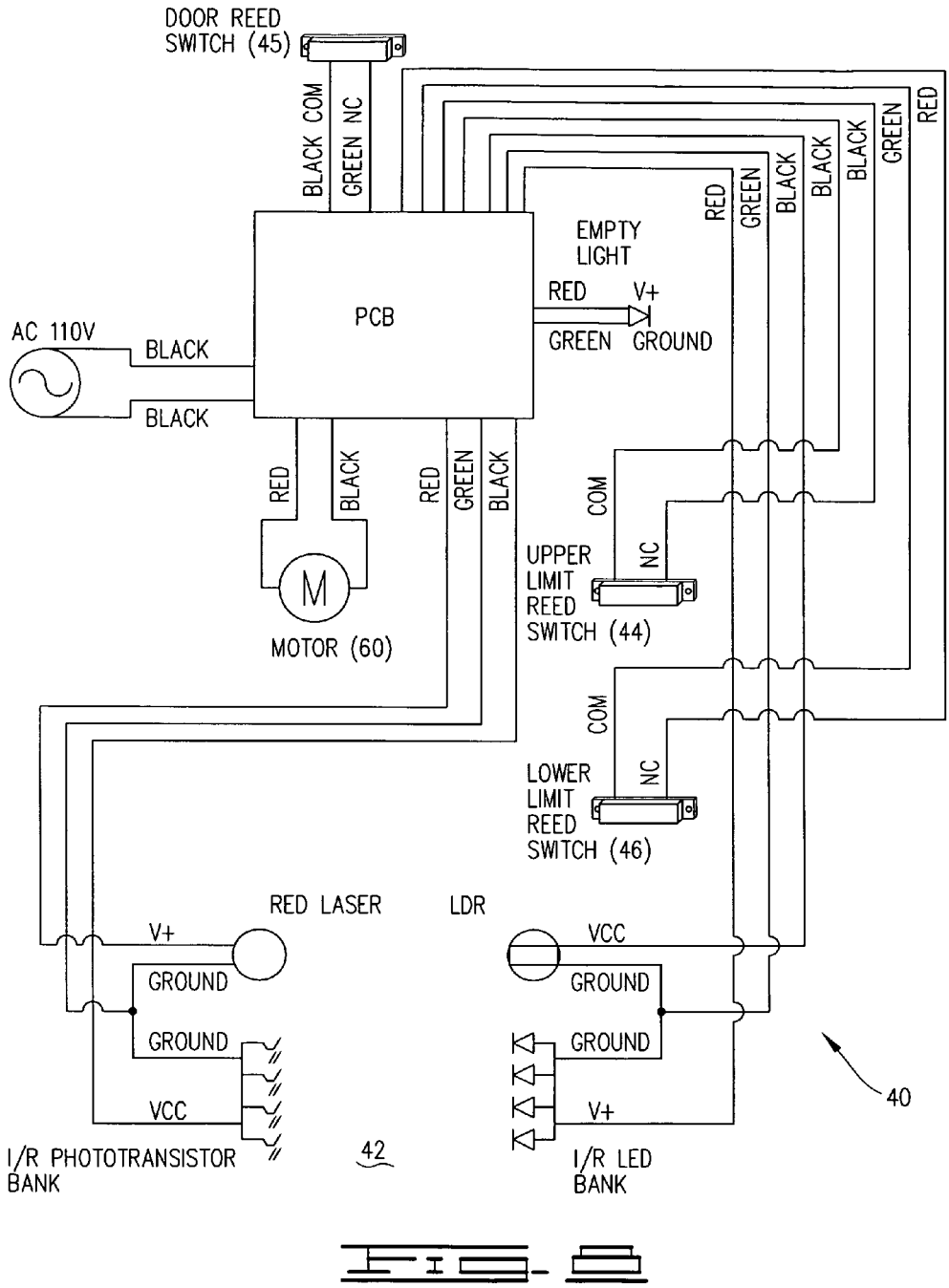

A sanitary lid dispensing device 10 providing a sanitary lid 100 to a person serving the beverage without contact with any other lid, as shown in FIGS. 1-7, the device comprising a cabinet 20 having a front service enclosure 50 defining at least one service compartment 52 with a side door 54 having a side hinge 55 attaching the side door 54 to a side 24 of the cabinet 20, FIGS. 3-4, an upper controller enclosure 30 defining a controller compartment 32 with an upper access door 34 having an upper hinge 36 attaching the access door 34 to a rear panel 26 of the cabinet 20, FIGS. 1-4, the controller compartment 32 containing the operational electronic components 40 providing the electrical relays, timers, breakers sensor relays, transformer and electrical wiring required to operate the device 10, shown by example in FIG. 8, a bi-directional motor 60 defining a motor mounting flange 66 mounting within the controller compartment 32 with a descending motor shaft 62 having a lateral shaft aperture 64, the motor shaft 62 placed in a vertical position through a lower controller enclosure outlet 38 into the at least one service compartment 52, at least one externally threaded rotary rod 70 having an upper end 72 defining a motor shaft socket 73 within which the motor shaft 62 is inserted and retained by a shaft pin 65 inserted through a lateral bore 74 in the motor shaft socket 72 and the lateral shaft aperture 64 of the motor shaft 62, FIG. 7, the motor shaft 62 and the motor shaft socket 72 connecting below or within the lower enclosure outlet 38, FIG. 4, the rotary rod 70 further defining an external thread 75 and a lower end 76 terminating a tapered conical tip 77, FIG. 5, a press plate 80 having a flat lower surface 82, side margins 84 and an internally threaded central rod bore 86 which threadably engages the external threads 75 of the rotary rod 70, FIGS. 6-7, the press plate 80 traveling vertically up or down the threaded rotary rod 70 as the rod rotates, the side margins 84 maintaining the press plate 80 within the at least one service compartment 52 in a horizontal position during vertical movement, a presence sensor 42 located within the at least one service compartment 52 near the lower end of the cabinet 20, which, when activated, sends a signal to the operational electronic components 40 causing the motor 60 to rotate the threaded rotary rod 70 in a programmed incremental amount, urging the press plate 80 downward against a top lid 100*a* in the plurality of stacked sanitary lids 100, FIG. 5, forcing the plurality of stacked lids 100 downward along the rotary rod 70, and expelling a lowest lid 100*z* in the plurality of stacked lids 100 from the tapered conical tip 77 of the rotary rod 70 below the lower end 76 of the rotary rod 70 within the at least one service compartment 52 at the lower end 28 of the cabinet 20.

The device 10 may also be selectively inoperable when one or more of the upper access door 34 or the front panel 54 is open. This may be provided by closure sensors 45, provided on the respective door 34 or panel 54 and the cabinet 20, as demonstrated in FIG. 3. The device 10 may also include a lower plate sensor 46, FIG. 4, which send a signal alert to the operational electronic components 40 to notify an operator of the device when the top lid 100*a* has been dispensed with the lower plate sensor 46 being activated by the presence of the press plate 80 at a lowest point of travel along the threaded drive shaft 80 and the rotary rod 70 with the rod bore 86 of the press plate 80 prohibited from being disengaged from the lower end 76 of the rotary rod 70, retracting the press plate 80 to an uppermost fully retracted position closest to the motor shaft socket 73. It is also contemplated that the device 10 may also include an upper plate sensor 44, FIG. 4, to indicate when the press plate 80 is fully retracted and ready for a refill of a fresh stacked plurality of sanitary lids 100 upon the rotary rod 70. The device would also include an AC power connector, not shown, or the device may be supplied with an internal power supply, also not shown.

To reload the device with another stacked plurality of sanitary lids 100, the front panel 54 is opened and a fresh stacked plurality of sanitary lids 100 would be forced upon the rotary rod 70 upon which the press plate 80 has been fully retracted to a point at or near the motor shaft socket 73, by forcing the tapered conical tip 77 of the rotary rod 70 through a central opening or a straw insertion point of each stacked sanitary lid 100 until the rotary rod 70 is full of the fresh stacked plurality of sanitary lids 100 and the top sanitary lid 100*a* is against the lower surface 82 of the press plate 80. Once loaded, the front panel 54 is closed and the device 10 is restored to operational status to further dispense more sanitary lids. It might be a wise and safe procedure to deactivate the machine by unplugging the device from a power source or by providing the device 10 with a power shutoff switch 48, FIG. 2.

Figure 1:
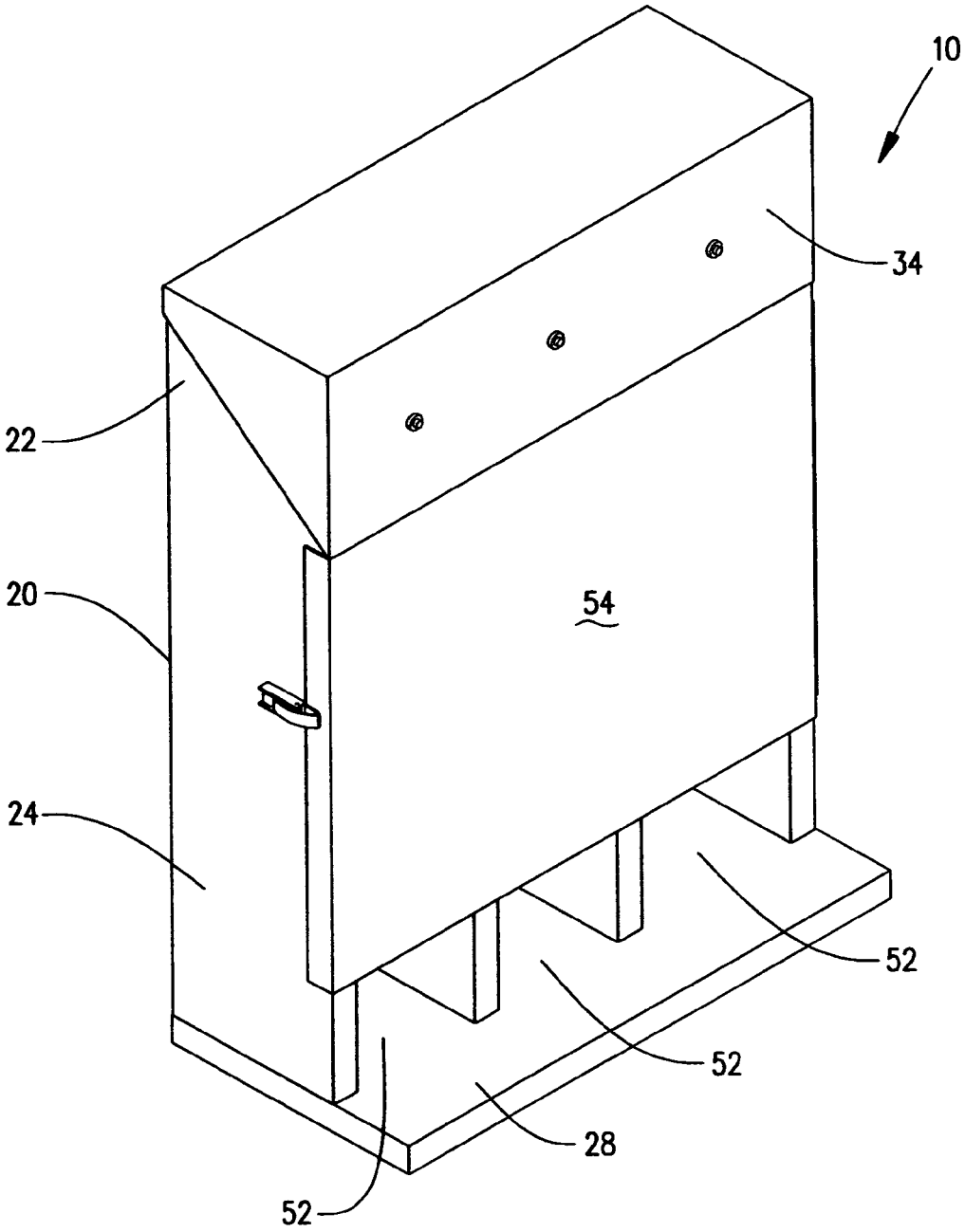
FIG. 1 is a front perspective view of the sanitary lid dispenser with the upper access door and the front panel closed.
Figure 2:
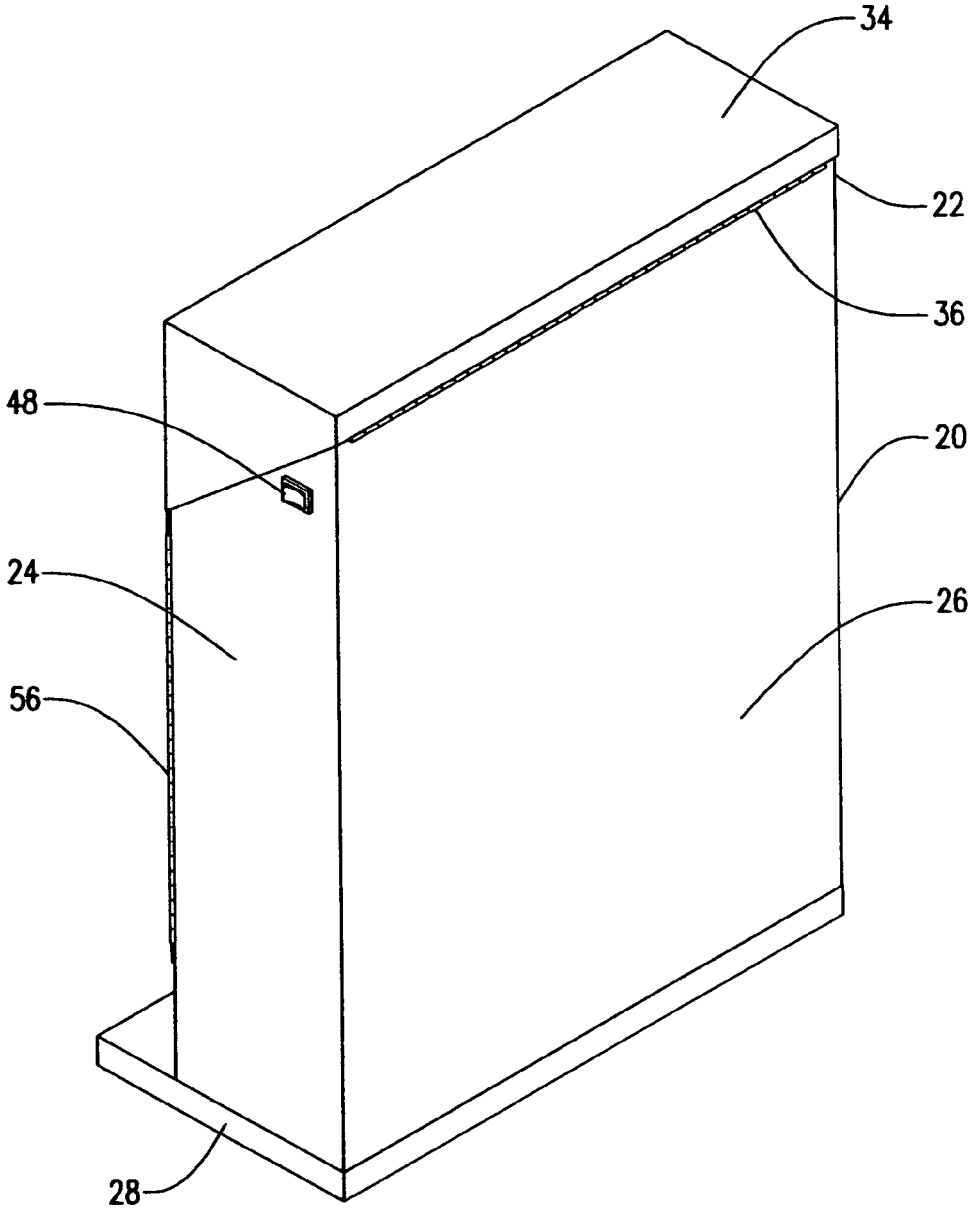
FIG. 2 is a rear perspective view of the lid dispenser with the upper access door closed and the showing the side hinge attached between the front panel and side of the cabinet in a closed position.

As shown in FIGS. 1 and 3-4, the device may provide more than one service compartment 52 with the ability to dispense sanitary lids of different sizes from a common device. It is preferred that the device 10 be provided as a table top device for placement near a beverage dispenser. It is also indicated in FIGS. 3-4, that there be provided a space below the lower end 76 of the rotary rod 70 of sufficient area to place a cup, bowl or container so that the sanitary lid being dispensed would be able to fall upon the top of the beverage cup, bowl or container, although it is contemplated that the lid may be dispensed into a sanitary hand of an operator. The device may be provided for public use by locating the device in a public access area or use by food service workers behind a counter in a secure area.

While the invention has been particularly shown and described with reference to a preferred embodiment thereof, it will be understood by those skilled in the art that changes in form and detail may be made therein without departing from the spirit and scope of the invention.

We claim:

1. A sanitary lid dispensing device to provide a dispensing of a single sanitary lid for a beverage container from a plurality of stacked sanitary lids to a person serving a beverage, comprising:

a cabinet having a front service enclosure defining at least one service compartment with a front panel having a side hinge attaching said front panel to a side of said cabinet, an upper controller enclosure defining a controller compartment with an upper access door having an upper hinge attaching said upper access door to a rear panel of said cabinet;

operational electronic components contained within said controller compartment providing electrical relays, timers, breakers sensor relays, transformer and electrical wiring required to operate said device, including a bi-directional motor defining a motor mounting flange mounting within said controller compartment with a descending motor shaft having a lateral shaft aperture, said motor shaft placed in a vertical position through a lower controller enclosure outlet into said at least one service compartment;

at least one externally threaded rotary rod having an upper end defining a motor shaft socket within which said motor shaft is inserted and retained by a shaft pin inserted through a lateral bore in said motor shaft socket and said lateral shaft aperture of said motor shaft, said motor shaft and said motor shaft socket connecting below or within said lower enclosure outlet, said rotary rod further defining an external thread and a lower end terminating into a tapered conical tip wherein said plurality of stacked sanitary lids are retained upon said rotary rod through a central bore of said plurality of stacked sanitary lids;

a press plate having a flat lower surface, side margins and an internally threaded central rod bore threadably engaging said external threads of said rotary rod, said press plate traveling vertically up and down said threaded rotary rod as said rod rotates, said side margins maintaining said press plate within said at least one service compartment in a horizontal position during vertical movement; and a presence sensor, activated by the placement of a hand within said device, located within said service compartment below said internal frame member which, when activated, activates said operational electronic components to cause said motor to rotate said threaded rotary rod in a programmed incremental amount, urging said press plate downward against said plurality of stacked sanitary lids, forcing said plurality of stacked lids downward along said rotary rod, expelling said lowest lid in from said lower end of said rotary rod within said at least one service compartment.

2. The device as disclosed in claim 1, further comprising:

said front service enclosure provides at least one closure switch rendering said device inoperable when said front panel is open.

3. The device as disclosed in claim 1, further comprising:

said device has more than one said segregated service compartment with each said segregated front service compartment having independently operable bi-directional motors, externally threaded rotary rods, each said rotary rod having separate pluralities of stacked sanitary lids upon each said rotary rod, and independently movable press plates moving independently along each said rotary rod, and individual presence sensors within each said service compartment activating each said bi-directional motor to rotate each respective rotary rod within each said segregated front service compartment.

4. The device as disclosed in claim 1, further comprising:

a lower plate sensor which sends a signal alert to said operational electronic components providing notification when all said plurality of stacked sanitary lids have been dispensed from said rotary rod, with said lower plate sensor being activated by a presence of said press plate near said lower end of said rotary rod preventing said internally threaded central rod bore of said press plate from disengagement with said lower end of said rotary rod, retracting said press plate to a fully retracted position near said motor shaft socket to load another plurality of stacked sanitary lids, and an upper plate sensor to indicate when said press plate is fully retracted and safe to open said front panel to refill said rotary rod with a fresh stacked plurality of sanitary lids.

5. The device as disclosed in claim 1, further comprising:

said device has more than one said segregated service compartment with each said segregated front service compartment having independently operable bi-directional motors, externally threaded rotary rods, each said rotary rod having separate pluralities of stacked sanitary lids upon each said rotary rod, and independently movable press plates moving independently along each said rotary rod, and individual presence sensors within each said service compartment activating each said bi-directional motor to rotate each respective rotary rod within each said segregated front service compartment, and each said service compartment further provides a lower plate sensor which sends a signal alert to said operational electronic components providing notification when all said plurality of stacked sanitary lids are dispensed from said respective rotary rod, with each said lower plate sensor being activated by a presence of said respective press plate near said lower end of said respective rotary rod preventing said internally threaded central rod bore of said respective press plate from disengagement with said lower end of said respective rotary rod, retracting each said respective press plate independently to a fully retracted position near said respective motor shaft socket to load another plurality of stacked sanitary lids upon said empty rotary rod and an upper plate sensor to indicate when said respective press plate with said respective service compartment is fully retracted and safe to open said front panel to refill said empty rotary rod with a fresh stacked plurality of sanitary lids.

* * * * *